US009963810B2

(12) United States Patent
Sasaki et al.

(10) Patent No.: US 9,963,810 B2
(45) Date of Patent: May 8, 2018

(54) FLAME RETARDANT NONWOVEN FABRIC, FORMED PRODUCT, AND COMPOSITE STACK

(71) Applicant: KURARAY CO., LTD., Kurashiki-shi (JP)

(72) Inventors: Masahiro Sasaki, Saijo (JP); Yasuhiro Shirotani, Saijo (JP)

(73) Assignee: KURARAY CO., LTD., Kurashiki-shi (JP)

( * ) Notice: Subject to any disclaimer, the term of this patent is extended or adjusted under 35 U.S.C. 154(b) by 33 days.

(21) Appl. No.: 14/899,687

(22) PCT Filed: Jun. 26, 2014

(86) PCT No.: PCT/JP2014/067000
§ 371 (c)(1),
(2) Date: Dec. 18, 2015

(87) PCT Pub. No.: WO2014/208671
PCT Pub. Date: Dec. 31, 2014

(65) Prior Publication Data

US 2016/0145782 A1 May 26, 2016

(30) Foreign Application Priority Data

Jun. 28, 2013 (JP) ..... 2013-135700
Nov. 14, 2013 (JP) ..... 2013-236078

(51) Int. Cl.

| | |
|---|---|
| ***D04H 1/54*** | (2012.01) |
| ***D04H 3/16*** | (2006.01) |
| ***D04H 1/551*** | (2012.01) |
| ***D04H 1/56*** | (2006.01) |
| *D01F 6/74* | (2006.01) |

(52) U.S. Cl.
CPC ..... *D04H 1/54* (2013.01); *D04H 1/551* (2013.01); *D04H 1/56* (2013.01); *D04H 3/16* (2013.01); *D01F 6/74* (2013.01)

(58) Field of Classification Search
CPC . D01F 6/74; D04H 4/54; D04H 1/551; D04H 3/16
See application file for complete search history.

(56) References Cited

U.S. PATENT DOCUMENTS

2003/0216099 A1* 11/2003 Berrigan ..... D01D 5/0985 442/409
2008/0116129 A1 5/2008 Oosterbroek et al.
2008/0248271 A1 10/2008 Erb et al.
2009/0304953 A1 12/2009 Dijkema et al.
2012/0015184 A1 1/2012 Endo et al.
2013/0123437 A1 5/2013 Endo et al.
2014/0037957 A1* 2/2014 Peters ..... D01D 1/09 428/401

FOREIGN PATENT DOCUMENTS

| | | | | |
|---|---|---|---|---|
| CN | 1867645 | A | 11/2006 | |
| CN | 101091016 | A | 12/2007 | |
| CN | 101490335 | A | 7/2009 | |
| CN | 102362021 | A | 2/2012 | |
| EP | 2 412 850 | A1 | 2/2012 | |
| EP | 3124666 | A1 * | 2/2017 | ..... D04H 1/4326 |
| JP | 3-180588 | A | 8/1991 | |
| JP | 5-140337 | A | 6/1993 | |
| JP | 2005-263957 | A | 9/2005 | |
| JP | 2011-127252 | A | 6/2011 | |
| JP | 2012-41644 | A | 3/2012 | |
| JP | 2012-72507 | A | 4/2012 | |
| JP | 5309896 | B2 | 10/2013 | |
| WO | 2010/109962 | A1 | 9/2010 | |
| WO | 2012/014713 | A1 | 2/2012 | |
| WO | WO 2015/009962 | A1 | 1/2015 | |

OTHER PUBLICATIONS

International Search Report dated Sep. 30, 2014 in PCT/JP2014/067000 filed Jun. 26, 2014.
Combined Office Action and Search Report dated Nov. 21, 2016 in Chinese Patent Application No. 201480036987.0 (with English language translation and English translation of categories of cited documents).
Ke Qin Fei, et al., "Study of Nonwoven Fabric" Don Hwa University Press, First Edition, Sep. 30, 2004, pp. 156-160 and pp. 260-270.
Extended European Search Report dated Jan. 2, 2017 in Patent Application No. 14816776.0.

* cited by examiner

*Primary Examiner* — Arti Singh-Pandey
(74) *Attorney, Agent, or Firm* — Oblon, McClelland, Maier & Neustadt, L.L.P.

(57) ABSTRACT

With a nonwoven fabric made of fibers mainly composed of amorphous polyetherimide having a melt viscosity at 330° C. from 100 to 3000 Pa·s and an average fiber diameter from 1 to 10 μm, a nonwoven fabric which is excellent in flame retardancy and can have a small thickness within a range from 5 to 900 μm with strength being maintained because of its denseness can be provided.

17 Claims, 1 Drawing Sheet

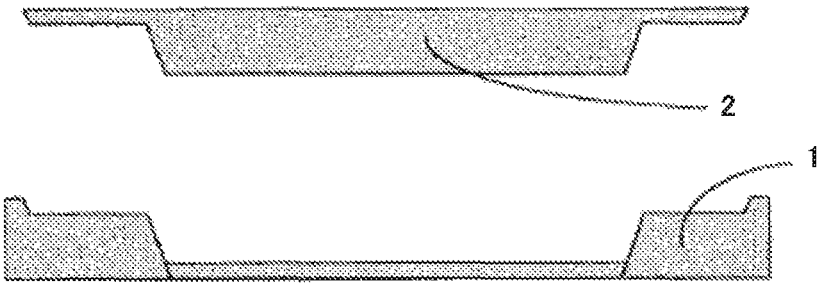
2
1

FLAME RETARDANT NONWOVEN FABRIC, FORMED PRODUCT, AND COMPOSITE STACK

TECHNICAL FIELD

The present invention relates to a nonwoven fabric (a flame retardant nonwoven fabric) which has flame retardancy and can be decreased in thickness with strength being maintained. The present invention also relates to a formed product obtained by heating such a nonwoven fabric according to the present invention and thermally fusing some or all of amorphous polyetherimide fibers and to a composite stack including the nonwoven fabric or the formed product according to the present invention.

BACKGROUND ART

A nonwoven fabric made of extra-fine fibers is manufactured from split fibers or with a flash spinning method or a melt blown method, and made use for filter applications. The nonwoven fabric, however, is mainly composed of a resin such as polypropylene, nylon, or polyethylene terephthalate, and hence flame retardancy or heat resistance has been insufficient and use thereof at a high temperature has not been suitable. Though some techniques for manufacturing a nonwoven fabric from fibers composed of a flame retardant polymer have been attempted, such an unfavorable condition as melt fracture or high melt tension takes place in an attempt to obtain extra-fine fibers, and it has been difficult to obtain a nonwoven fabric formed from flame retardant extra-fine fibers with good productivity.

Japanese Patent Laying-Open No. 3-180588 (PTD 1) discloses a nonwoven fabric made of flame retardant polyetherimide (which may hereinafter be referred to as PEI) fibers alone and a composite nonwoven fabric of PEI fibers and inorganic fibers. The nonwoven fabric in PTD 1, however, requires impregnation with a chlorine-based aliphatic hydrocarbon compound such as methylene chloride or trichloromethane for adhesion among the PEI fibers, and use of a solvent may affect characteristics of the PEI fibers. Such a solvent has recently been found to affect human bodies or environments, and development of an alternate technique has been demanded from a point of view of load imposed on environments or cost associated with recovery of the solvent.

As a nonwoven fabric made of PEI fibers, a nonwoven fabric mainly made of PEI fibers having a specific structure and three-dimensionally interlaced with one another has been disclosed (Japanese Patent Laying-Open No. 2012-41644 (PTD 2)). Amorphous PEI is not only high in melting point and excellent in heat resistance owing to its molecular frame but also excellent in flame retardancy, and it is made use of for fibers or engineering plastics. Examples in PTD 2, however, disclose only a nonwoven fabric made with a spun lace method, which has a relatively high fineness with a fiber diameter being 2.2 dtex (corresponding to 15 μm).

CITATION LIST

Patent Document

PTD 1: Japanese Patent Laying-Open No. 3-180588
PTD 2: Japanese Patent Laying-Open No. 2012-41644

SUMMARY OF INVENTION

An object of the present invention is to provide a nonwoven fabric which is excellent in flame retardancy and can have a small thickness within a range from 5 to 900 μm with strength being maintained because of its denseness.

The present inventors have conducted dedicated studies in order to achieve the object above, found that a nonwoven fabric which is excellent in flame retardancy and can have a small thickness within a range from 5 to 900 μm with strength being maintained because of its denseness is obtained by using a resin mainly composed of amorphous PEI having melt viscosity at 330° C. within a specific range, and completed the present invention.

Namely, a first embodiment of the present invention is directed to a nonwoven fabric made of fibers mainly composed of amorphous PEI having a melt viscosity at 330° C. from 100 to 3000 Pa·s and an average fiber diameter from 1 to 10 μm, which may be manufactured with a melt blown method or a spunbond method.

A second embodiment of the present invention is directed to a formed product obtained by heating the nonwoven fabric and thermally fusing some or all of amorphous PEI fibers.

A third embodiment of the present invention is directed to a composite stack including the nonwoven fabric or the formed product.

According to the present invention, extra-fine fibers can be obtained by setting a melt viscosity at 330° C. of amorphous PEI, which is a main component, to be within a specific range, and consequently, a nonwoven fabric which can achieve both of flame retardancy and maintained strength in spite of a thickness being decreased to a range from 5 to 900 μm can be obtained. In addition, a composite stack can also be obtained by stacking the nonwoven fabric (or the formed product obtained by heating the nonwoven fabric and thermally fusing some or all of amorphous PEI fibers) on a base material layer.

BRIEF DESCRIPTION OF DRAWINGS

FIG. 1 is a diagram schematically showing a mold used for evaluating shapeability of a reinforced fiber base material in Examples.

DETAILED DESCRIPTION

[Amorphous PEI]

The present invention will specifically be described below.

Amorphous PEI employed in the present invention refers to a polymer containing an aliphatic, alicyclic, or aromatic ether unit and cyclic imide as repeating units, and it is not particularly limited so long as it has amorphousness and melt formability. Here, being "amorphous" can be confirmed by subjecting obtained fibers to a differential scanning calorimetry system (DSC), increasing a temperature at a rate of 10° C./minute in nitrogen, and checking whether or not there is an endothermic peak. When the endothermic peak is very broad and no clear endothermic peak can be determined, such a case indicates a level which does not give rise to a problem in actual use, and determination as amorphous may substantially be made. So long as effects of the present invention are not diminished, a main chain of amorphous PEI may contain cyclic imide or a structural unit other than ether bond, such as an aliphatic, alicyclic, or aromatic ester unit or an oxycarbonyl unit.

A polymer expressed with a general formula below is suitably employed as amorphous PEI. In the formula, R1 represents a divalent aromatic residue having 6 to 30 carbon atoms, and R2 represents a divalent organic group selected from the group consisting of a divalent aromatic residue having 6 to 30 carbon atoms, an alkylene group having 2 to 20 carbon atoms, a cycloalkylene group having 2 to 20 carbon atoms, and a polydiorganosiloxane group chain-terminated with an alkylene group having 2 to 8 carbon atoms.

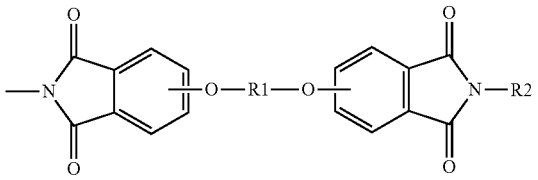

Amorphous PEI should have a melt viscosity at 330° C. from 100 to 3000 Pa·s. When the melt viscosity is lower than 100 Pa·s, fiber dust or resin particles called shots which are produced due to failure in formation of fibers may often be generated during spinning. When the melt viscosity exceeds 3000 Pa·s, a trouble may occur during polymerization or granulation, such as difficulty in obtaining extra-fine fibers and generation of oligomers during polymerization. A melt viscosity at 330° C. is preferably from 200 to 2700 Pa·s and more preferably from 300 to 2500 Pa·s.

Amorphous PEI has a glass transition temperature preferably not lower than 200° C. When the glass transition temperature is lower than 200° C., heat resistance of an obtained nonwoven fabric may be poor. As amorphous PEI has a higher glass transition temperature, a nonwoven fabric better in heat resistance is preferably obtained. When the glass transition temperature is excessively high, a fusion temperature also becomes high during fusion, and a polymer may be decomposed during fusion. Amorphous PEI has a glass transition temperature preferably from 200 to 230° C. and further preferably from 205 to 220° C.

A molecular weight of amorphous PEI is not particularly limited. In consideration of mechanical characteristics, dimension stability, or processability of obtained fibers or nonwoven fabric, however, a weight average molecular weight (Mw) is preferably from 1000 to 80000. Use of amorphous PEI having a high molecular weight is preferred because of superiority in strength of fibers and heat resistance. From a point of view of costs for manufacturing a resin or costs for a process into fibers, a weight average molecular weight is preferably from 2000 to 50000 and more preferably from 3000 to 40000.

In the present invention, a condensate of 2,2-bis[4-(2,3-dicarboxyphenoxy)phenyl]propane dianhydride and m-phenylenediamine or p-phenylenediamine which mainly has a structural unit shown in a formula below is preferably employed for amorphous PEI from a point of view of amorphousness, melt formability, and cost. This PEI is commercially available from SABIC Innovative Plastics under the trademark ULTEM.

[Amorphous PEI Fibers]

Amorphous PEI fibers forming the nonwoven fabric according to the present invention may contain an antioxidant, an antistatic agent, a radical inhibitor, a delusting agent, an ultraviolet absorbing agent, a flame retardant, or an inorganic substance, so long as the effects of the present invention are not diminished. Specific examples of such an inorganic substance include carbon nanotube, fullerene, silicate such as talc, wollastonite, zeolite, sericite, mica, kaolin, clay, pyrophyllite, silica, bentonite, and alumina silicate, metal oxide such as silicon oxide, magnesium oxide, alumina, zirconium oxide, titanium oxide, and iron oxide, carbonate such as calcium carbonate, magnesium carbonate, and dolomite, sulfate such as calcium sulfate and barium sulfate, hydroxide such as calcium hydroxide, magnesium hydroxide, and aluminum hydroxide, glass beads, glass flakes, frosting, ceramic beads, boron nitride, silicon carbide, carbon black, and graphite. Furthermore, for the purpose of improvement in resistance to hydrolysis of fibers, a terminal sequestering agent such as a mono- or di-epoxy compound, a mono- or poly-carbodiimide compound, a mono- or di-oxazoline compound, or a mono- or di-azirine compound may be contained.

[Amorphous PEI Nonwoven Fabric (Flame Retardant Nonwoven Fabric)]

The nonwoven fabric according to the present invention made of amorphous PEI fibers is excellent in flame retardancy. Such a nonwoven fabric according to the present invention can be obtained with a flash spinning method or a melt blown method. From a point of view of relative ease in manufacturing of a nonwoven fabric made of extra-fine fibers and ability to minimize influence on environments without the necessity for a solvent during spinning, the melt blown method or a spunbond method is preferred. In the case of the melt blown method, a conventionally known melt blown apparatus can be employed as a spinning apparatus, and spinning is preferably carried out under such conditions as a spinning temperature from 350 to 440° C., a hot air temperature (a primary air temperature) from 360 to 450° C., and an amount of air from 5 to 50 $Nm^3$ per 1 m of nozzle length. In the case of the spunbond method, a conventionally known spunbond apparatus can be employed as a spinning apparatus, and spinning is preferably carried out under such conditions as a spinning temperature from 350 to 440° C., a hot air temperature (a temperature of air for drawing) from 360 to 450° C., and airstream for drawing from 500 to 5000 m/minute.

Fibers forming the nonwoven fabric thus obtained should have an average fiber diameter from 1 to 10 μm. When the fibers forming the nonwoven fabric have an average fiber diameter smaller than 1 μm, fiber dust is generated and formation of a web is difficult. The average fiber diameter exceeding 10 μm is not preferred from a point of view of denseness. The average fiber diameter is more preferably from 1.2 to 9.5 μm and further preferably from 1.5 to 9 μm.

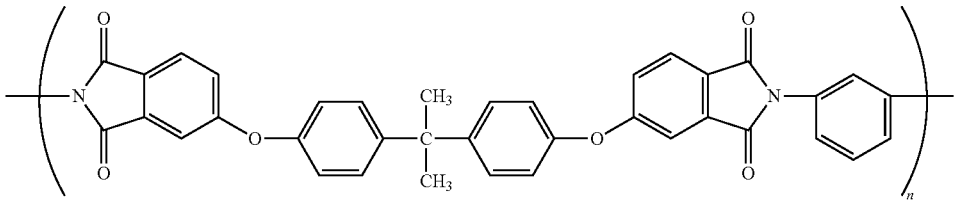

The nonwoven fabric has a thickness preferably from 5 to 900 The nonwoven fabric according to the present invention can have a small thickness in a range from 5 to 900 μm with strength being maintained because of its denseness. When the nonwoven fabric has a thickness smaller than 5 strength may become low and break during a process may be likely. When the thickness exceeds 900 μm, fusion between fibers may be weak and formation of a web may be difficult. The nonwoven fabric has a thickness more preferably from 8 to 800 μm and further preferably from 10 to 500 μm.

The nonwoven fabric has a basis weight preferably from 1 to 1000 g/m$^2$. When the nonwoven fabric has a basis weight smaller than 1 g/m$^2$, strength may become low and break during a process may be likely. A basis weight of the nonwoven fabric exceeding 1000 g/m$^2$ is not preferred from a point of view of productivity. The nonwoven fabric has a basis weight more preferably from 2 to 950 g/m$^2$ and further preferably from 3 to 900 g/m$^2$.

A material formed from extra-fine fibers as described above is employed for the nonwoven fabric according to the present invention, so that a structure dense also as a composite stack which will be described later can be obtained. When denseness of the nonwoven fabric is low, voids are created in a portion where an amount of fibers is small and appearance may be poor in manufacturing of a formed product which will be described later. When the nonwoven fabric is low in denseness, an uneven amount of fibers may lead to non-uniform impregnation of a reinforcement material with molten fibers in manufacturing of a composite stack which will be described later. Therefore, the nonwoven fabric has an air permeability preferably not higher than 120 cc/cm$^2$/sec. When the nonwoven fabric has an air permeability exceeding 120 cc/cm$^2$/sec., denseness may be low. The nonwoven fabric has an air permeability more preferably not higher than 100 cc/cm$^2$/sec. and further preferably not higher than 90 cc/cm$^2$/sec. From a point of view of ease in air escape during heating and compression in molding of a composite stack, the nonwoven fabric has an air permeability preferably not lower than 1 cc/cm$^2$/sec.

The nonwoven fabric has a strength in a vertical direction preferably not lower than 2 N/15 mm. When the nonwoven fabric has a strength in a vertical direction lower than 2 N/15 mm, break during a process may be likely. The nonwoven fabric has a strength more preferably not lower than 5 N/15 mm and further preferably not lower than 7 N/15 mm. From a point of view of ease in cutting during a cutting process, the nonwoven fabric has a strength in a vertical direction preferably not higher than 100 N/15 mm.

A nonwoven fabric obtained with the manufacturing method above may three-dimensionally be interlaced through spun lacing, needle punching, or steam jetting.

[Formed Product]

Depending on a purpose as appropriate, the obtained nonwoven fabric may be subjected to hot pressing. The present invention provides also a formed product obtained by heating the nonwoven fabric according to the present invention as described above and thermally fusing some or all of amorphous PEI fibers. Though a condition for heating the nonwoven fabric is not particularly restricted, thermal compression forming under a condition, for example, of a temperature within a range from 200 to 300° C. and a range from 10 to 100 MPa is given as a suitable example. Such a formed product is in a shape, for example, of a board, and may serve for such an application as a heat insulating material, a protection material, or an insulating material.

[Composite Stack]

The present invention includes a composite stack including the nonwoven fabric or the formed product obtained with the manufacturing method above as a part of the composite stack. A method of manufacturing a composite stack is not particularly restricted. A composite stack can be obtained by stacking a nonwoven fabric or a formed product on a base material layer, or obtained by directly manufacturing a nonwoven fabric or a formed product on a base material layer. A material for forming the base material layer is not particularly restricted, and selection from among carbon fibers, glass fibers, and synthetic fibers can freely be made.

EXAMPLES

Though the present invention will specifically be described below with reference to Examples, the present invention is not limited thereto.

[Melt Viscosity]

Measurement was conducted under a condition of a temperature of 330° C. and a shear velocity r=1200 sec$^{-1}$, with the use of Capilograph 1B of Toyo Seiki Seisaku-Sho, Ltd.

[Average Fiber Diameter (μm)]

An average fiber diameter was obtained by photographing a nonwoven fabric as being magnified with a scanning electron microscope, measuring diameters of any 100 fibers, and calculating an average value.

[Thickness (μm) of Nonwoven Fabric]

A thickness of a nonwoven fabric was obtained by leaving an obtained continuous fiber nonwoven fabric in a standard environment (at a temperature of 20° C. and at a relative humidity of 65%) for 4 hours or longer, measuring a thickness at 5 locations with PEACOCK Dial-Thickness Gauge H Type (manufactured by Yasuda Seiki Seisakusho, Ltd., ϕ 10 mm×180 g/cm$^2$), and calculating an average value.

[Basis Weight (g/m$^2$) of Nonwoven Fabric]

Measurement was conducted under JIS P8124.

[Air Permeability (cc/cm$^2$/sec) of Nonwoven Fabric]

Measurement was conducted in compliance with a Frazier method defined under JIS L1913 "Test Methods for Nonwovens" in connection with air permeability.

[Spinnability]

Discharge of a polymer during spinning and the obtained nonwoven fabric were observed, and spinnability was evaluated based on criteria below.

A: Absence of fiber dust, production of shots, and clogging of nozzle

B: Presence of any of fiber dust, shots, and clogging of nozzle

[Flame Retardancy]

A char length at the time when a lower end of a sample arranged at 45° C. was heated for 10 seconds with a Meker burner spaced apart by 50 mm from the lower end of the sample was measured in compliance with the test method defined under JIS A1322. Flame retardancy was evaluated based on criteria below, based on results of the char length.

a: Char length shorter than 5 cm b: Char length not shorter than 5 cm

[Strength (in Vertical Direction)]

A nonwoven fabric was cut to a width of 15 mm, and with an autograph manufactured by Shimadzu Corporation, the nonwoven fabric was stretched in a vertical direction at a tension rate of 10 cm/minute and a value of a load at the time of tear was measured.

[Comprehensive Evaluation of Nonwoven Fabric]

A case that all of an air permeability not higher than 120 cc/cm$^2$ sec., spinnability "A", and flame retardancy "a" of the obtained nonwoven fabric were satisfied was defined as pass and a case of failure to satisfy any one of them was defined as fail.

[Press Formability of Nonwoven Fabric]

In connection with press formability of a nonwoven fabric, a cross-section of an obtained formed product in a board shape was photographed as being magnified with a scanning electron microscope and a ratio of an area occupied by voids in the cross-section was evaluated.

[Bending Strength (MPa) and Bending Elasticity (GPa) of Composite Stack]

Measurement for a composite stack was conducted under ASTM790.

[Shapeability of Reinforced Fiber Base Material]

In connection with shapeability of a reinforced fiber base material, appearance of an obtained composite stack was observed and evaluated based on criteria below at the time of molding with the use of a mold (a metal frame 1 of a mold and an upper lid 2 of the mold) as schematically shown in FIG. 1.

C: Appearance is good, with no wrinkle being observed.

D: Appearance is not good, with wrinkles or holes being observed.

[Ease in Impregnation of Reinforced Fiber Base Material]

In connection with ease in impregnation of a reinforced fiber base material used for a composite stack, a cross-section of a composite stack was photographed as being magnified with a scanning electron microscope and a ratio of an area occupied by voids in the cross-section was evaluated.

Example 1

Amorphous polyetherimide having a melt viscosity at 330° C. of 500 Pa·s was used to spin a melt blown nonwoven fabric having a basis weight of 25 g/m$^2$ and an average fiber diameter of 2.2 μm at a spinning temperature of 420° C. Physical properties of a nonwoven fabric subsequently subjected to calendering at a roll temperature of 200° C. and a contact pressure of 100 kg/cm are shown in Table 1.

Example 2

Amorphous polyetherimide having a melt viscosity at 330° C. of 900 Pa·s was used to spin a melt blown nonwoven fabric having a basis weight of 24 g/m$^2$ and an average fiber diameter of 5.7 μm at a spinning temperature of 420° C. Physical properties of a nonwoven fabric subsequently subjected to calendering under the same conditions as in Example 1 are shown in Table 1.

Example 3

Amorphous polyetherimide having a melt viscosity at 330° C. of 2200 Pa·s was used to spin a melt blown nonwoven fabric having a basis weight of 27 g/m$^2$ and an average fiber diameter of 8.2 μm at a spinning temperature of 435° C. Physical properties of a nonwoven fabric subsequently subjected to calendering under the same conditions as in Example 1 are shown in Table 1.

Example 4

Amorphous polyetherimide the same as in Example 1 was used to spin a spunbond nonwoven fabric having a basis weight of 24 g/m$^2$ and an average fiber diameter of 5.1 μm at a spinning temperature of 415° C. Physical properties of a nonwoven fabric subsequently subjected to calendering under the same conditions as in Example 1 are shown in Table 2.

Example 5

Amorphous polyetherimide the same as in Example 2 was used to spin a spunbond nonwoven fabric having a basis weight of 27 g/m$^2$ and an average fiber diameter of 6.8 μm at a spinning temperature of 415° C. Physical properties of a nonwoven fabric subsequently subjected to calendering under the same conditions as in Example 1 are shown in Table 2.

Example 6

Amorphous polyetherimide the same as in Example 3 was used to spin a spunbond nonwoven fabric having a basis weight of 27 g/m$^2$ and an average fiber diameter of 9 μm at a spinning temperature of 435° C. Physical properties of a nonwoven fabric subsequently subjected to calendering under the same conditions as in Example 1 are shown in Table 2.

Example 7

A formed product in a board shape was fabricated by subjecting the nonwoven fabric fabricated in Example 1 to thermal compression forming for 1 minute at a temperature of 240° C. and a pressure of 20 MPa.

Example 8

Four nonwoven fabrics fabricated in Example 1 were layered on each of upper and lower surfaces of a carbon fiber textile (manufactured by Toho Tenax Co., Ltd. "W-3101: 3K textile, weight per unit area of 200 g/m$^2$), and a resultant product was defined as one set. A reinforced fiber base material was thus obtained. A composite stack was obtained by stacking 6 fiber base materials, thereafter subjecting the stack to heating and compression molding for 3 minutes at a temperature of 240° C. and a pressure of 20 MPa, and molding the stack into a shape of a flat plate. Table 5 shows physical properties of the obtained composite stack.

Comparative Example 1

A melt blown nonwoven fabric was spun from amorphous polyetherimide having a melt viscosity at 330° C. of 80 Pa·s at a spinning temperature of 420° C., however, many shots were produced on a web and the result was dissatisfactory. The obtained melt blown nonwoven fabric had a basis weight of 27 g/m$^2$ and an average fiber diameter of 8.2 μm. Table 3 shows physical properties of the nonwoven fabric subjected to calendering under the conditions the same as in Example 1.

Comparative Example 2

An attempt to spin a melt blown nonwoven fabric from amorphous polyetherimide having a melt viscosity at 330° C. of 3100 Pa·s was made at a spinning temperature of 435° C., however, a nozzle was clogged due to a high melt viscosity, and the result was dissatisfactory. The obtained melt blown nonwoven fabric had a basis weight of 23 g/m$^2$ and an average fiber diameter of 21 μm. Table 3 shows physical properties of the nonwoven fabric subjected to calendering under the conditions the same as in Example 1.

Comparative Example 3

Multifilaments having a fiber diameter of 18 μm and a dry heat shrinkage of 3.5% at 200° C. were obtained at a spinning temperature of 390° C. from amorphous polyetherimide having a melt viscosity at 330° C. of 900 Pa·s. The obtained multifilaments were crimped, followed by cutting. Then, short fibers having a fiber length of 51 mm were fabricated and subjected to a card to thereby fabricate a fiber web having a basis weight of 28 g/m$^2$. This web was placed on a support net of a hydroentangling machine, and staples were interlaced and integrated with one another by injecting water at a pressure from 20 to 100 kgf/cm$^2$ onto opposing surfaces. Thereafter, dry heat treatment at a temperature from 110 to 160° C. was carried out to obtain a nonwoven fabric. Table 3 shows physical properties of the obtained nonwoven fabric.

Comparative Example 4

A nonwoven fabric having a basis weight of 28 g/m$^2$ was fabricated from rayon fibers (having a fiber diameter of 9 μm, a fiber length of 40 mm, and a melting point of 260° C.) with a method the same as in Comparative Example 3. Table 3 shows physical properties of the obtained nonwoven fabric.

Comparative Example 5

A formed product in a board shape was fabricated by subjecting the nonwoven fabric fabricated in Comparative Example 1 to thermal compression forming under conditions the same as in Example 7.

Comparative Example 6

A stack in a board shape was fabricated by subjecting the nonwoven fabric fabricated in Comparative Example 1 to thermal compression forming under conditions the same as in Example 8.

TABLE 1

| | Example 1 | Example 2 | Example 3 |
|---|---|---|---|
| Source Materials Forming Nonwoven Fabric | | | |
| Polymer Composition of Fibers | PEI | PEI | PEI |
| Melt Viscosity (Pa · S): 330° C. | 500 | 900 | 2200 |
| Features of Continuous Fiber Nonwoven Fabric | | | |
| Form of Continuous Fiber Nonwoven Fabric | Melt Blown | Melt Blown | Melt Blown |
| Spinning Temperature (° C.) | 420 | 420 | 435 |
| Average Fiber Diameter of Nonwoven Fabric (μm) | 2.2 | 5.7 | 8.2 |
| Thickness of Nonwoven Fabric (μm) | 30 | 34 | 41 |
| Basis Weight of Nonwoven Fabric (g/m$^2$) | 25 | 24 | 27 |
| Air Permeability of Nonwoven Fabric (cc/cm$^2$/scc) | 1 | 4 | 21 |
| Spinnability | A | A | A |
| Flame Retardancy | a | a | a |
| Strength (N/15 mm) | 7 | 10 | 8 |
| Comprehensive Evaluation | Pass | Pass | Pass |

TABLE 2

| | Example 4 | Example 5 | Example 6 |
|---|---|---|---|
| Source Materials Forming Nonwoven Fabric | | | |
| Polymer Composition of Fibers | PEI | PEI | PEI |
| Melt Viscosity (Pa · S): 330° C. | 500 | 900 | 2200 |
| Features of Continuous Fiber Nonwoven Fabric | | | |
| Form of Continuous Fiber Nonwoven Fabric | Spunbond | Spunbond | Spunbond |
| Spinning Temperature (° C.) | 415 | 415 | 435 |
| Average Fiber Diameter of Nonwoven Fabric (μm) | 5.1 | 6.8 | 9 |
| Thickness of Nonwoven Fabric (μm) | 32 | 37 | 46 |
| Basis Weight of Nonwoven Fabric (g/m$^2$) | 24 | 27 | 27 |
| Air Permeability of Nonwoven Fabric (cc/cm$^2$/sec) | 3 | 13 | 42 |
| Spinnability | A | A | A |
| Flame Retardancy | a | a | a |
| Strength (N/15 mm) | 14 | 22 | 16 |
| Comprehensive Evaluation | Pass | Pass | Pass |

TABLE 3

| | Comparative Example 1 | Comparative Example 2 | Comparative Example 3 | Comparative Example 4 |
|---|---|---|---|---|
| Source Materials Forming Nonwoven Fabric | | | | |
| Polymer Composition of Fibers | PEI | PEI | PEI | Rayon |
| Melt Viscosity (Pa · S): 330° C. | 80 | 3100 | 900 | — |
| Features of Continuous Fiber Nonwoven Fabric | | | | |
| Form of Continuous Fiber Nonwoven Fabric | Melt Blown | Melt Blown | Dry | Dry |
| Spinning Temperature (° C.) | 420 | 435 | — | — |
| Average Fiber Diameter of Nonwoven Fabric (μm) | 8.2 | 21 | 18 | 9 |
| Thickness of Nonwoven Fabric (μm) | 42 | 61 | 56 | 45 |
| Basis Weight of Nonwoven Fabric (g/m$^2$) | 27 | 23 | 28 | 26 |
| Air Permeability of Nonwoven Fabric (cc/cm$^2$/sec) | 84 | 237 | 132 | 40 |

TABLE 3-continued

| | Comparative Example 1 | Comparative Example 2 | Comparative Example 3 | Comparative Example 4 |
|---|---|---|---|---|
| Spinnability | B | B | A | A |
| Flame Retardancy | a | a | a | b |
| Strength (N/15 mm) | 3 | 5 | 15 | 7 |
| Comprehensive Evaluation | Fail | Fail | Fail | Fail |

TABLE 4

| | Example 7 | Comparative Example 5 |
|---|---|---|
| Nonwoven Fabric to be Source Material | | |
| Form of Continuous Fiber Nonwoven Fabric | Melt Blown | Melt Blown |
| Average Fiber Diameter of Nonwoven Fabric (μm) | 2.2 | 8.2 |
| Thickness of Nonwoven Fabric (μm) | 30 | 42 |
| Basis Weight of Nonwoven Fabric (g/m$^2$) | 25 | 27 |
| Air Permeability of Nonwoven Fabric (cc/cm$^2$/sec) | 1 | 84 |
| Continuous Fiber Nonwoven Fabric of Interest | Example 1 | Comparative Example 1 |
| Formed product in Board Shape | | |
| Thickness of Formed product (μm) | 12 | 18 |
| Air Permeability of Formed product (cc/cm$^2$/sec) | 0.5 | 7 |
| Press Formability [Ratio of Void Cross-Sectional Area in Formed product Cross-Sectional Area] (%) | 7 | 27 |

TABLE 5

| | Example 8 | Comparative Example 6 |
|---|---|---|
| Source Materials Forming Nonwoven Fabric | | |
| Polymer Composition of Fibers | PEI | PEI |
| Melt Viscosity (Pa · S): 330° C. | 500 | 80 |
| Features of Continuous Fiber Nonwoven Fabric | | |
| Form of Continuous Fiber Nonwoven Fabric | Melt Blown | Melt Blown |
| Spinning Temperature (° C.) | 420 | 420 |
| Average Fiber Diameter of Nonwoven Fabric (μm) | 2.2 | 8.2 |
| Thickness of Nonwoven Fabric (μm) | 30 | 27 |
| Basis Weight of Nonwoven Fabric (g/m$^2$) | 25 | 27 |
| Air Permeability of Nonwoven Fabric (cc/cm$^2$/sec) | 1 | 84 |
| Continuous Fiber Nonwoven Fabric Used | Example 1 | Comparative Example 1 |
| Reinforced Fiber Layer | | |
| Material for Fibers | Carbon Fiber | Carbon Fiber |
| Form | Textile | Textile |
| Basis Weight of Reinforced Fiber Layer (g/m$^2$) | 200 | 200 |
| Specifications of Stack | | |
| Reinforced Fiber:Continuous Fiber Nonwoven Fabric (Weight Ratio) | 1:1 | 1:1.08 |
| Thickness of Stack (mm) | 1 | 1 |
| Bending Strength (MPa) | 480 | 311 |
| Bending Elasticity (GPa) | 32.4 | 21.2 |
| Flame Retardancy | a | a |
| Shapeability | C | D |

TABLE 5-continued

| | | |
|---|---|---|
| Ease in Impregnation [Ratio of Void Cross-Sectional Area in Stack Cross-Sectional Area] (%) | 4 | 25 |

As is clear from Tables 1 to 2, the nonwoven fabrics obtained in Examples 1 to 6 are flame retardant, as well as high in strength, low in air permeability, and high in denseness, in spite of a very small thickness.

As is clear from Table 3, in Comparative Examples 1 and 2, a melt viscosity was out of the range from 100 to 3000 Pa·s, and hence spinnability is poor and an even nonwoven fabric cannot be obtained.

As is clear from Table 3, though a nonwoven fabric formed from amorphous PEI fibers is obtained in Comparative Example 3, a dense structure cannot be obtained because of a large average fiber diameter.

As is clear from Table 3, Comparative Example 4 does not contain amorphous PEI fibers, and therefore flame retardancy could not be exhibited either.

In addition, based on comparison between Example 7 and Comparative Example 5, Example 7 was smaller in number of spots on the surface and could obtain a very dense formed product. Voids were generated in appearance or a large number of press spots were observed due to shots in Comparative Example 5.

Based on comparison between Example 8 and Comparative Example 6 which represent the composite stacks with the reinforced fiber base material, voids were generated due to shots in Comparative Example 6, and hence bending strength was low, and results of ease in impregnation and shapeability were both poor. In Example 8, however, there were few voids, bending strength was high, and a dense formed product high in ease in impregnation and shapeability could be obtained.

The invention claimed is:

1. A nonwoven fabric, comprising fibers mainly comprising an amorphous polyetherimide having a melt viscosity at 330° C. from 100 to 3000 Pa·s and an average fiber diameter from 1 to 10 μm, wherein the nonwoven fabric has an air permeability of 120 cc/cm$^2$/sec or less.

2. The nonwoven fabric according to claim 1, which is obtained by a melt blown method or a spunbond method.

3. A composite stack, comprising the nonwoven fabric of claim 1.

4. A formed product obtained by heating the nonwoven fabric of claim 1 and thermally fusing some or all of amorphous polyetherimide fibers.

5. A composite stack, comprising the formed product of claim 4.

6. A composite stack, comprising the nonwoven fabric of claim 2.

7. The nonwoven fabric according to claim 1, having an air permeability of 1 to 120 cc/cm$^2$/sec.

8. The nonwoven fabric according to claim 1, having an air permeability oft to 100 cc/cm$^2$/sec.

9. The nonwoven fabric according to claim 1, having an air permeability of 1 to 90 cc/cm$^2$/sec.

10. The nonwoven fabric according to claim 1, wherein the melt viscosity of the amorphous polyetherimide at 330° C. is from 200 to 2700 Pa·s.

11. The nonwoven fabric according to claim 1, wherein the melt viscosity of the amorphous polyetherimide at 330° C. is from 300 to 2500 Pa·s.

12. The nonwoven fabric according to claim 1, wherein the average fiber diameter is from 1.2 to 9.5 μm.

13. The nonwoven fabric according to claim 1, wherein the average fiber diameter is from 1.5 to 9 μm.

14. The nonwoven fabric according to claim 1, having a thickness of 5 to 900 μm.

15. The nonwoven fabric according to claim 1, having a thickness of 8 to 800 μm.

16. The nonwoven fabric according to claim 1, having a thickness of 10 to 500 μm.

17. The nonwoven fabric according to claim 1, having a strength in a vertical direction of 2 N/15 mm to 100 N/15 mm.

* * * * *